US012613030B2

(12) United States Patent
Garossino et al.

(10) Patent No.: US 12,613,030 B2
(45) Date of Patent: Apr. 28, 2026

(54) COMBUSTION BURNER WITH FIXED VANES

(71) Applicant: DE-MISSION INC., Calgary (CA)

(72) Inventors: Richard B. Garossino, Leduc (CA); Kenneth A. Lawton, Sherwood Park (CA)

( * ) Notice: Subject to any disclaimer, the term of this patent is extended or adjusted under 35 U.S.C. 154(b) by 311 days.

(21) Appl. No.: 18/266,550

(22) PCT Filed: Dec. 9, 2021

(86) PCT No.: PCT/CA2021/051771
§ 371 (c)(1),
(2) Date: Jun. 9, 2023

(87) PCT Pub. No.: WO2022/120488
PCT Pub. Date: Jun. 16, 2022

(65) Prior Publication Data

US 2024/0110698 A1 Apr. 4, 2024

(30) Foreign Application Priority Data

Dec. 11, 2020 (CA) ..... 3102511

(51) Int. Cl.
*F23D 14/02* (2006.01)
*F23D 14/24* (2006.01)
*F23D 14/70* (2006.01)

(52) U.S. Cl.
CPC ..... *F23D 14/02* (2013.01); *F23D 14/24* (2013.01); *F23D 14/70* (2013.01)

(58) Field of Classification Search
CPC ..... F23D 14/02; F23D 14/24; F23D 14/70
USPC ..... 431/354
See application file for complete search history.

(56) References Cited

U.S. PATENT DOCUMENTS

2007/0207426 A1* 9/2007 Perry ..... F23L 7/005 431/183
2008/0163627 A1 7/2008 Elkady et al.
2010/0180599 A1* 7/2010 Thomas ..... F23R 3/286 29/889.22
2012/0167570 A1 7/2012 Evulet
2014/0230701 A1 8/2014 Cheng et al.

FOREIGN PATENT DOCUMENTS

CN 107191932 B 8/2019
EP 0797051 B1 2/2003

* cited by examiner

*Primary Examiner* — Avinash A Savani

(57) ABSTRACT

A combustion burner includes a burner body with a central bore. A swirl generator insert is provided having vanes which impart a swirl pattern, with minimal pressure loss, to an axial flow of forced air passing from an air inlet end though the swirl generator. An annular fuel gas manifold has a plurality of gas jets positioned adjacent to the sidewall at spaced intervals 360 degrees around the gas manifold. A mixing chamber is positioned downstream of the gas manifold to mix fuel gas from the gas jets with the air exiting the swirl generator insert to create a fuel/air mixture. A combustion chamber is positioned downstream of the mixing chamber. An igniter passage extends through the burner body to position an igniter downstream of the mixing chamber to ignite the fuel/air mixture entering the combustion chamber.

7 Claims, 7 Drawing Sheets

COMBUSTION BURNER WITH FIXED VANES

FIELD

There is described a combustion burner and, in particular, a combustion burner having fixed vanes.

BACKGROUND

U.S. Pat. No. 5,562,438 (Gordon et al) titled "Flue Gas Recirculation Burner providing Low NOx Emissions" is an example of a burner that has fixed vanes. A cylindrical tangential mixer separately receives combustion air and flue gas through axial inlets. The mixed air and gas pass through a "vaned diffuser" which continues the tangential flow pattern, and thereafter fuel is introduced tangentially and combustion occurs.

SUMMARY

There is provided a combustion burner that includes a tubular burner body having a sidewall, an air inlet end, a combustion gases outlet end and a central bore that extends between the air inlet end and the combustion gases outlet end. A swirl generator insert is positioned across the central bore. The swirl generator insert has vanes which impart a swirl pattern, with minimal pressure loss, to an axial flow of forced air passing from the air inlet end though the swirl generator. An annular fuel gas manifold is positioned in the central bore. The gas manifold has a plurality of gas jets positioned adjacent to the sidewall at spaced intervals 360 degrees around the gas manifold. A mixing chamber is positioned downstream of the gas manifold to mix fuel gas from the gas jets with the air exiting the swirl generator insert to create a fuel/air mixture. A combustion chamber is positioned downstream of the mixing chamber. An igniter passage extends through the burner body to position an igniter downstream of the mixing chamber to ignite the fuel/air mixture entering the combustion chamber.

The combustion burner, as described above, is more fuel efficient, and produces lower NOx when compared to a standard draft combustion burner, as will hereinafter be further described.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
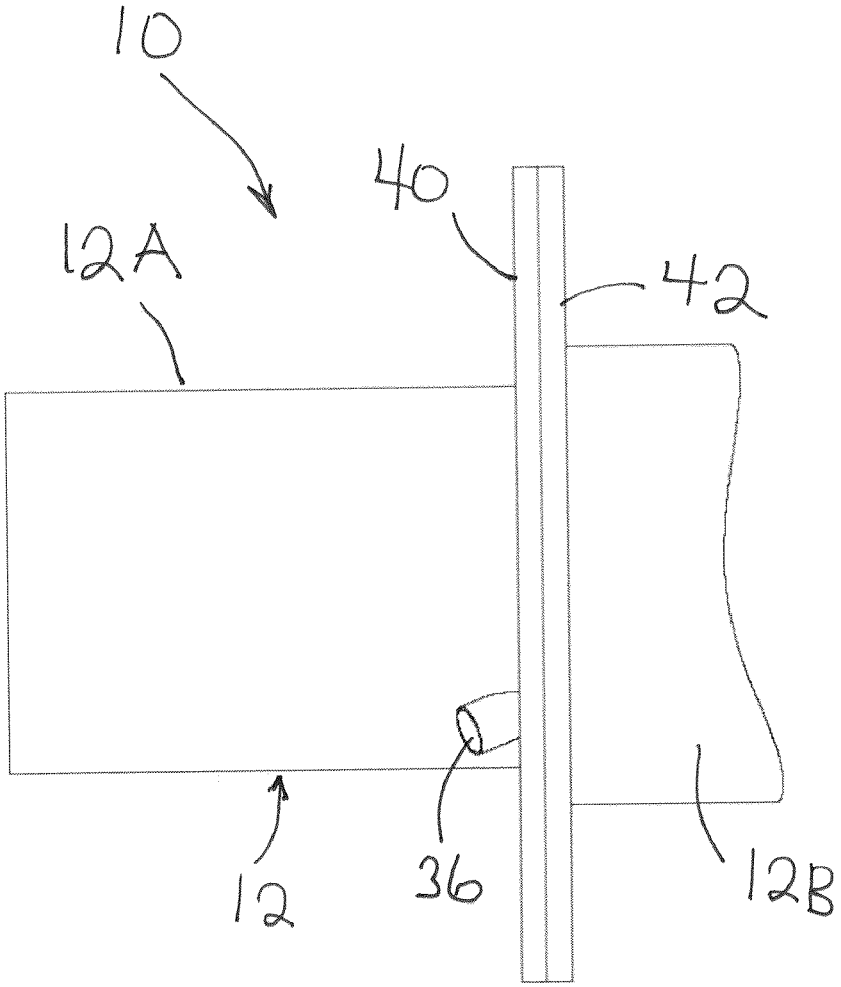
FIG. 1 is a side elevation view of a combustion burner.

A combustion burner generally identified by reference numeral 10, will now be described with reference to FIG. 1 through FIG. 6.

Structure and Relationship of Parts

Figure 4:
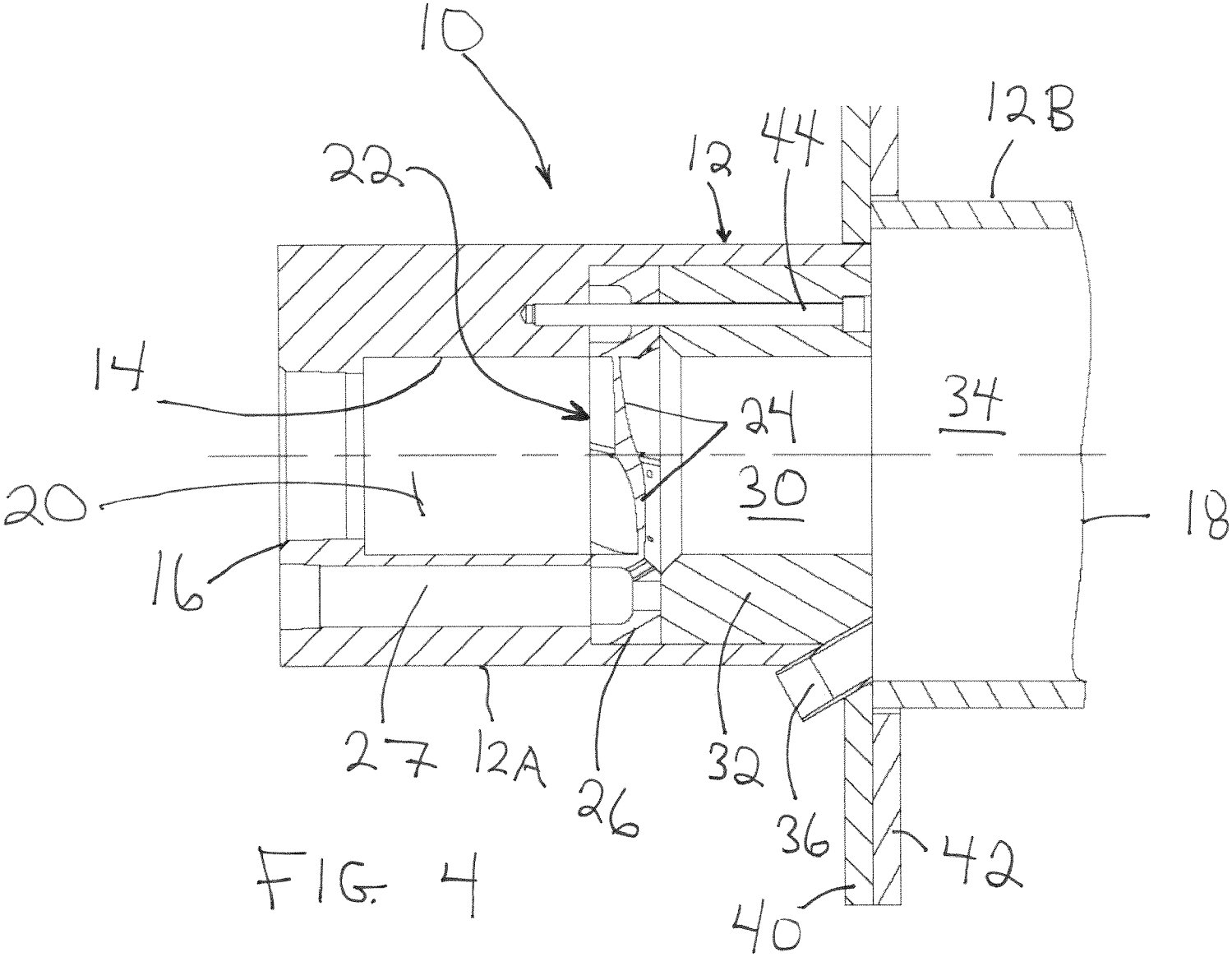
FIG. 4 is a section view take along section lines 4-4 of FIG. 3.

Referring to FIG. 4, combustion burner 10 includes a tubular burner body 12 having a sidewall 14, an air inlet end 16, a combustion gases outlet end 18 and a central bore 20 that extends between air inlet end 16 and combustion gases outlet end 18.

Figure 2:
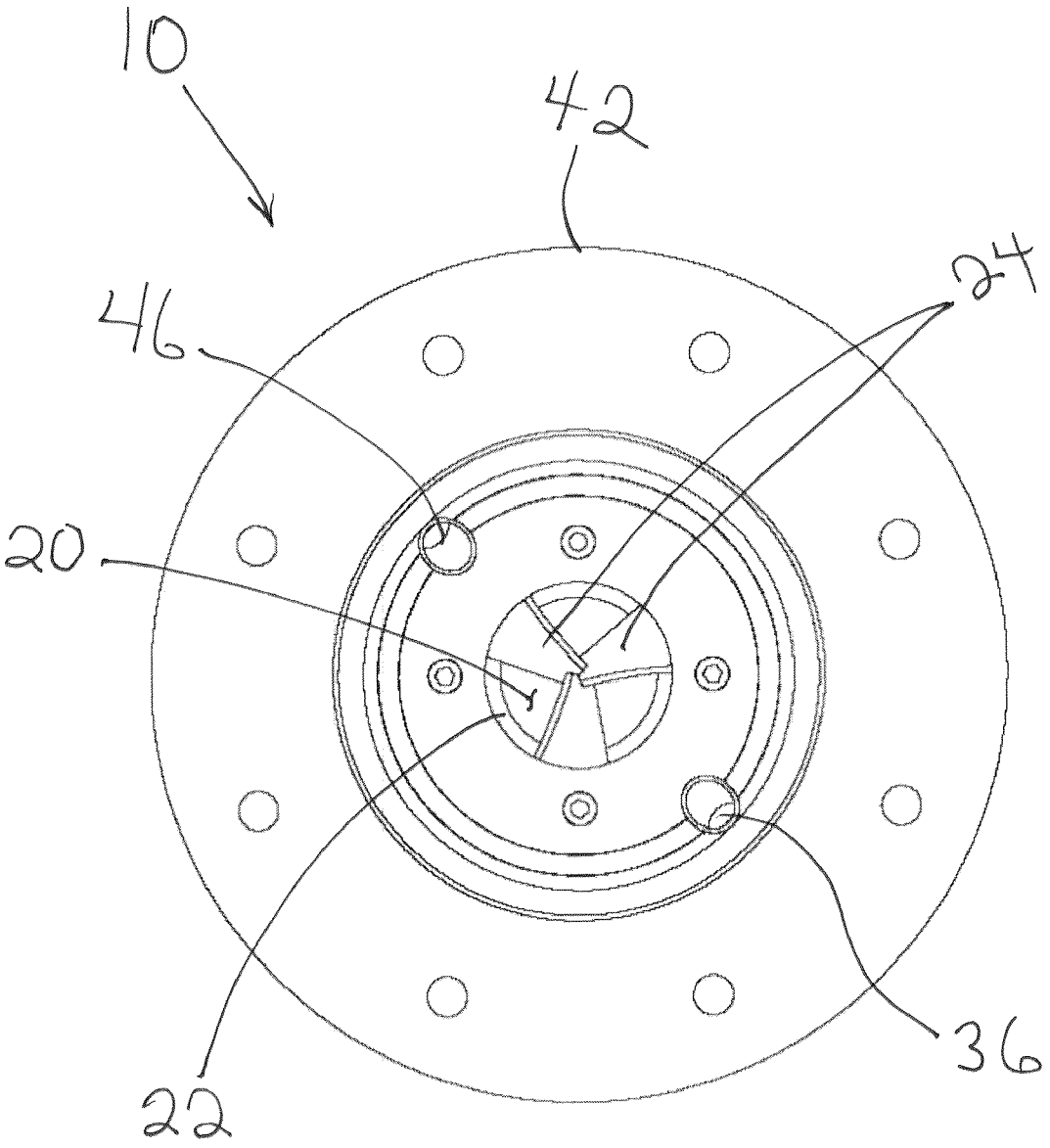
FIG. 2 is a first end elevation view of the combustion burner of FIG. 1 from a combustion gases outlet end.
Figure 3:
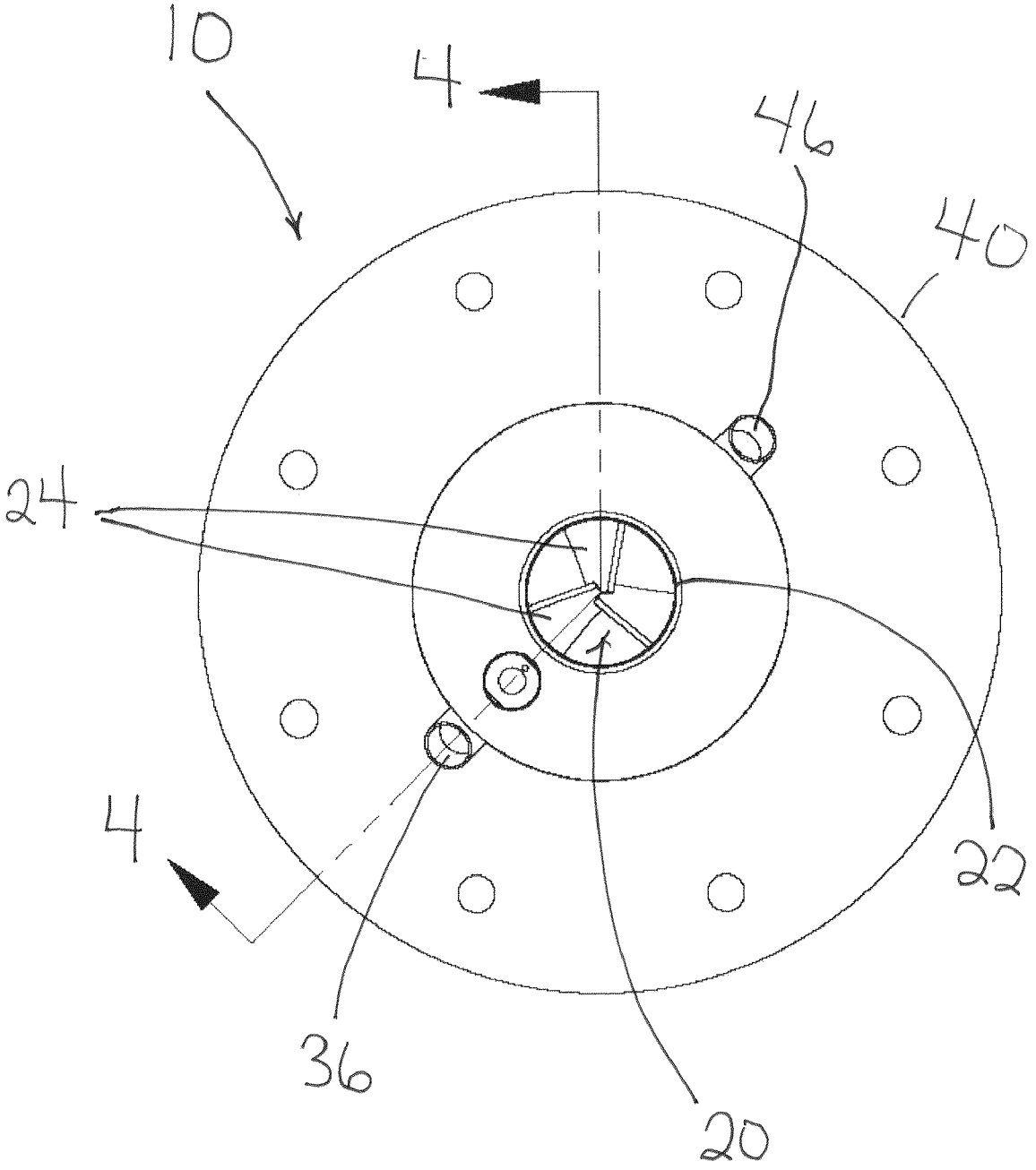
FIG. 3 is a second end elevation view of the combustion burner of FIG. 1 from an air inlet end.
Figure 6:
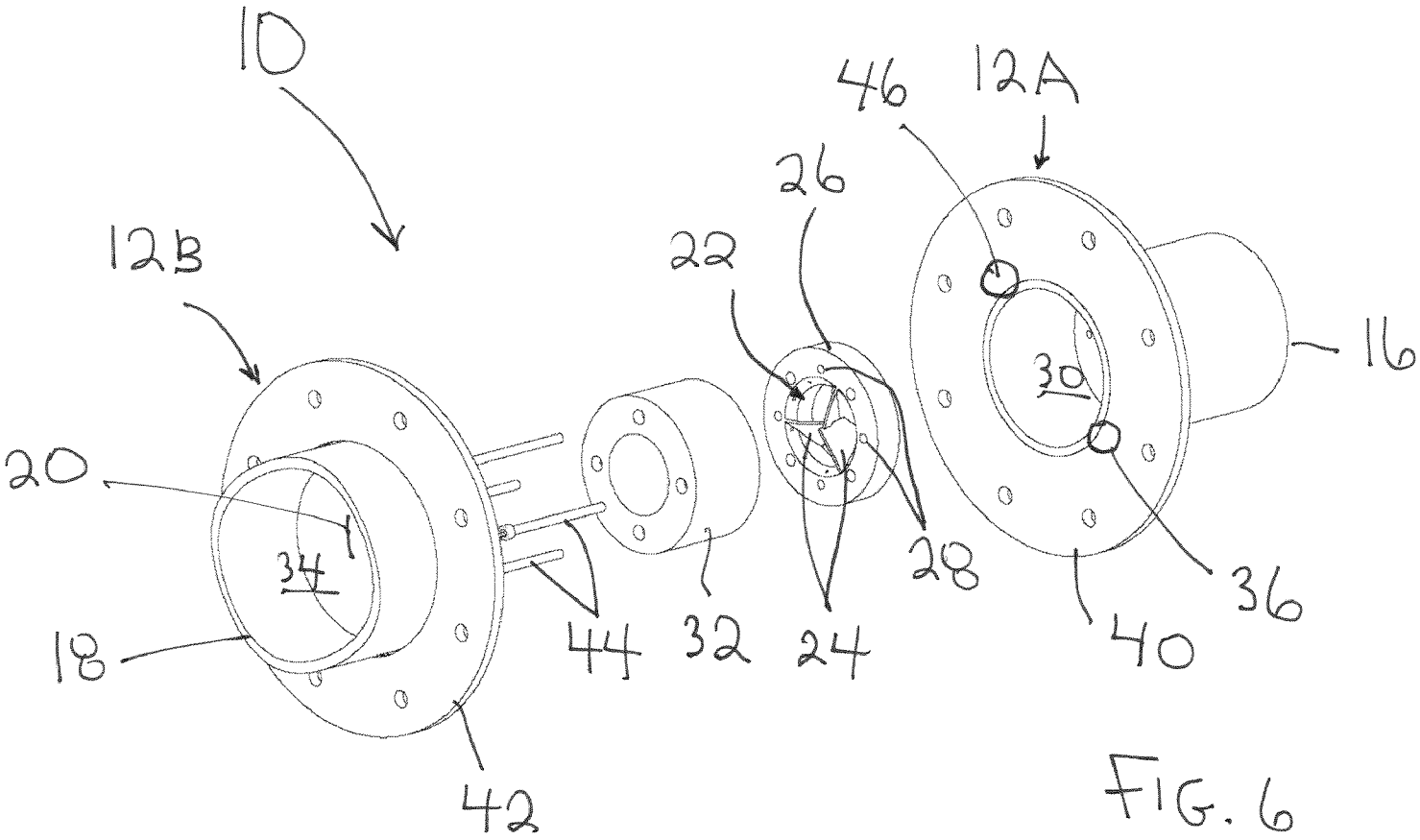
FIG. 6 is an exploded perspective view of the combustion burner of FIG. 1 from the combustion gases outlet end.

Referring to FIG. 2 through 4, a swirl generator insert, generally indicated by reference numeral 22 is positioned across central bore 20. Referring to FIG. 6, swirl generator insert 22 has vanes 24. Referring to FIG. 4, vanes 24 impart a swirl pattern, with minimal pressure loss, to an axial flow of forced air passing from air inlet end 16 though swirl generator insert 22. The swirl generator is referred to as an"insert" because it is "inserted" into a seating position in central bore 20. The swirl pattern can be changed, by replacing swirl generator insert 22 with another insert having different properties. Each swirl generator insert 22 is a convergent nozzle having vanes 24 which induce a circular flow. In order to provide minimal pressure loss, swirl generator insert 22 is relatively thin and has a diameter that exceeds it's length.

Referring to FIG. 4, an annular fuel gas manifold 26 is positioned in central bore 20. Gas manifold 26 receives fuel gas through gas supply passage 27. Referring to FIG. 6, gas manifold 26 has a plurality of gas jets 28. Upon assembly, gas jets are positioned adjacent to sidewall 14 at spaced intervals 360 degrees around gas manifold 26.

Figure 5:
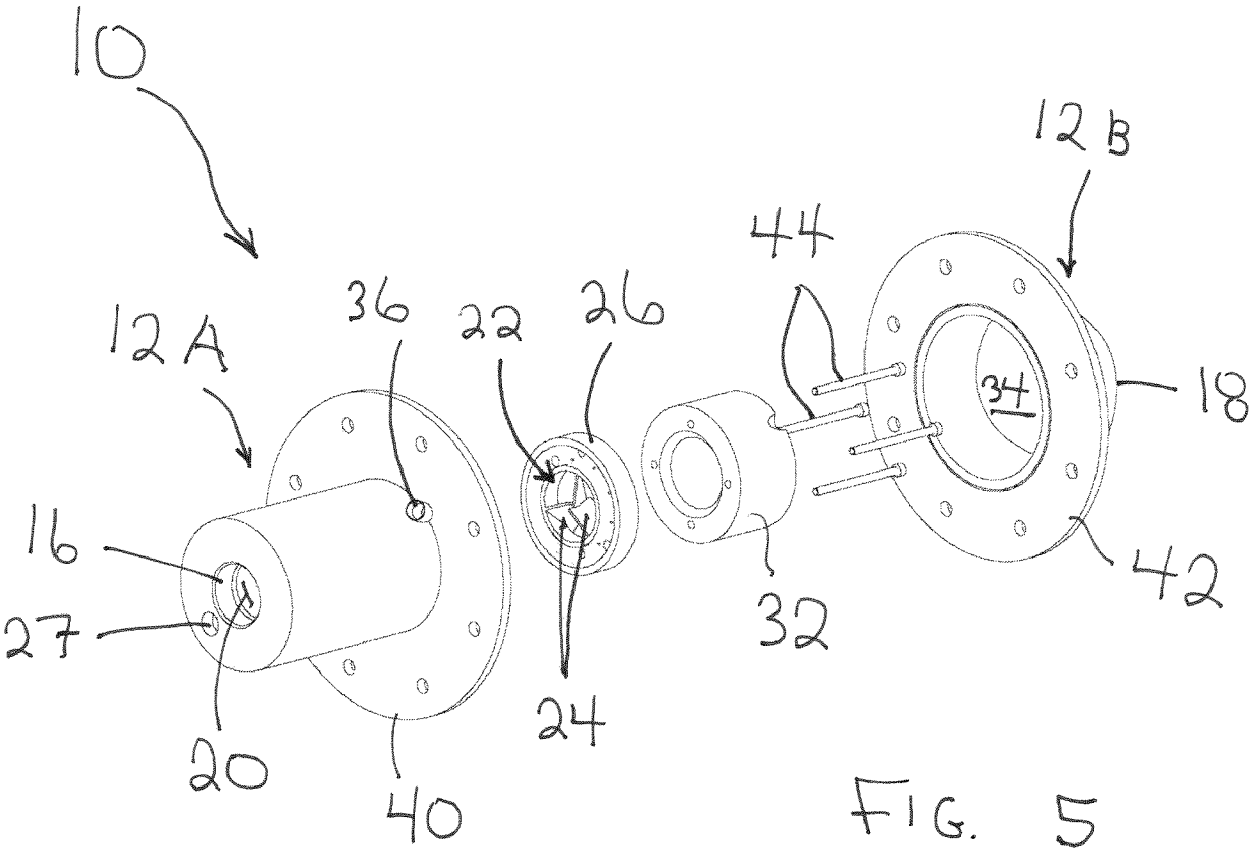
FIG. 5 is an exploded perspective view of the combustion burner of FIG. 1 from the air inlet end.

Referring to FIG. 4, a mixing chamber 30 is positioned downstream of gas manifold 26 to mix fuel gas from gas jets 28 with the air exiting swirl generator insert 22 to create a fuel/air mixture. Referring to FIG. 5 and FIG. 6, it is preferred that a central bore constricting annulus spool 32 be positioned in mixing chamber 30. As will hereinafter be described, the diameter of mixing chamber 30, as dictated by annulus spool 32 plays a role in what is referred to as the "Swirl Factor".

Referring to FIG. 4, a combustion chamber 34 is positioned downstream of the mixing chamber 30. Referring to FIG. 2 and FIG. 3, an igniter passage 36 extends through burner body 12. Referring to FIG. 4, the positioning of igniter passage 36 places an igniter (not shown) downstream of mixing chamber 30 to ignite the fuel/air mixture entering combustion chamber 34.

The characteristics of the air swirl is controlled by a combination of the swirl generator insert blade pitch, number of blades and surface texture, as well as the ratio of the radius of combustion chamber 34 to the diameter of the annulus spool 32.

Referring to FIG. 5 and FIG. 6, for ease of assembly, it is preferred that burner body 12 consists of a first portion 12A which houses mixing chamber 30 and a second portion 12B which houses combustion chamber 34. First portion 12A has a first flange 40. Second portion 12B has a second flange 42. Referring to FIG. 1, burner body 12 is assembled by coupling first flange 40 of first portion 12A with second flange 42 of second portion 12B. Referring to FIG. 4 through FIG. 6, during assembly swirl generator insert 22 is positioned within gas manifold 26. Bolts 44 are then used to secure annulus spool 32 and gas manifold 26 to first portion 12A of burner body 12.

Referring to FIG. 2 and FIG. 3, for improved monitoring, it is preferred that a sensor passage 46 is provided in burner body 12 to enable sensors to be inserted to monitor the combustion process. Suitable sensors are sold under the FIREYE brand.

Operation

Referring to FIG. 4, forced air enters central bore 20 and proceeds along central bore 20 until it hits the three deflecting vanes 24 of swirl generator insert 22. This produces a swirl pattern to the air. This swirling mass continues along central bore 20 until it passes thru fuel gas manifold 26 where it picks up gas from gas jets 28. The burner air flow is at higher pressure than the gas pressure and produces a low pressure zone at gas jets 28 as it rushes past. Gas jets 28 are arranged in a 360 degree around central bore 20, which combined with the air pulling the fuel allow for an even distribution of fuel gas into the swirling air flow. This rotating mixture proceeds down central bore 20, through mixing chamber 30 and then to combustion chamber 34 where it is ignited. The flame will anchor on sidewall 14 at the first part of combustion chamber 34. After a short combustion zone this hot swirling mass continues down combustion chamber 34 to exit into an appliance (not shown). If this appliance is a tube in shell heater, the rotation will continue down the fire tube, producing a very efficient heat transfer. One might expect to reduce fuel consumption in this kind of appliance by 40% compared to present natural draft burners.

Figure 4A:
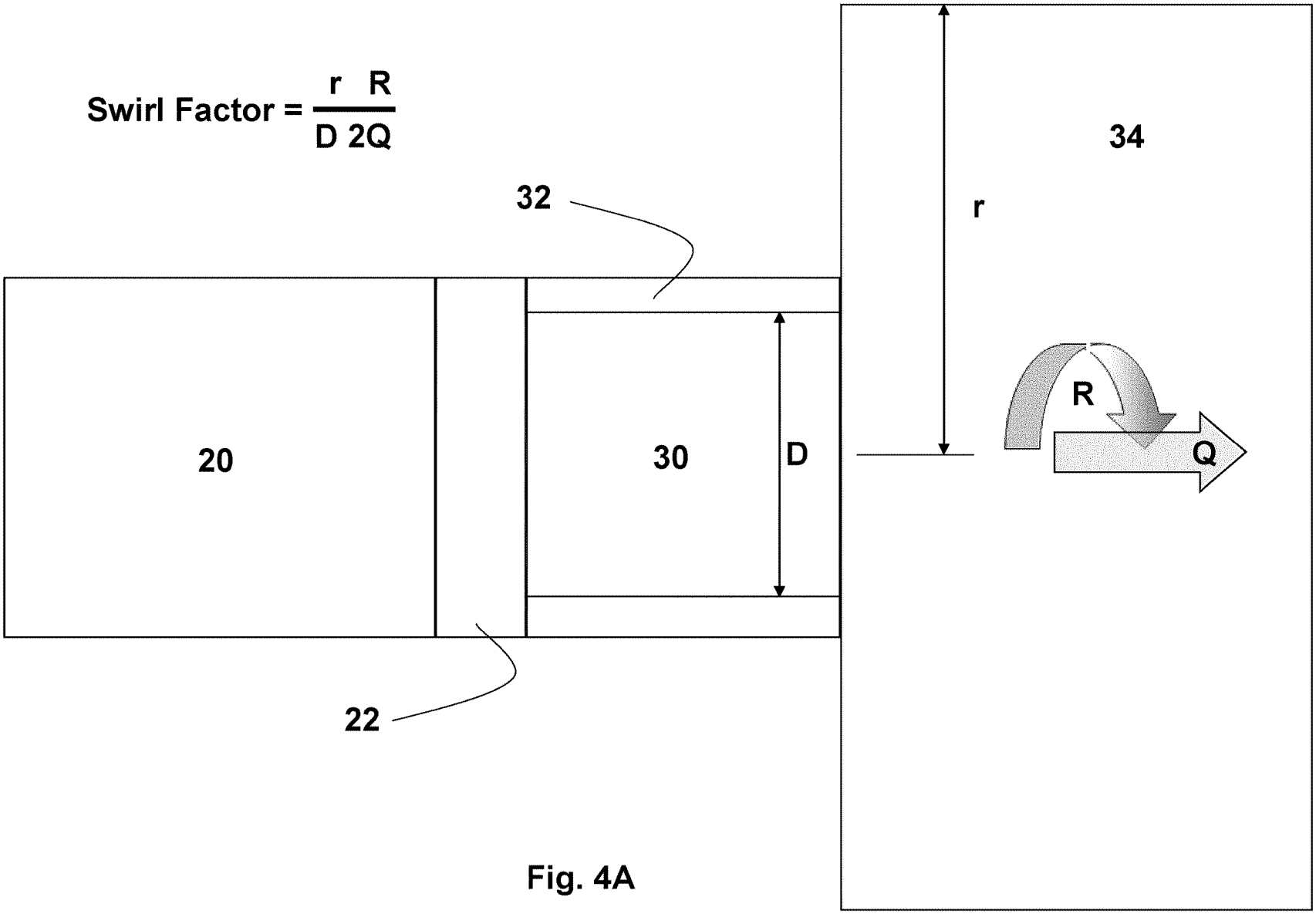
FIG. 4A is a simplified representation of FIG. 4, upon which has been superimposed key parameters.

Referring to FIG. 4A, the concept of the swirl generator insert can be compared to the dynamics of tornados. In this application, an axial flow of forced air rushing along central bore 20 is caused to swirl in a manner similar to a tornado. There are some key parameters that control the swirl, which we will refer to as the "Swirl Factor". One key parameter of the Swirl Factor is the diameter "D" of mixing chamber 30, this can be adjusted by changing the size of annulus spool 32. Another key parameter of the Swirl Factor is the radius "r" of combustion chamber 34, relative to diameter "D" of mixing chamber 30. Another key parameter of the Swirl Factor is the forward flow rate per unit length represented by Q. Another key parameter of the Swirl Factor is the rotation "R" imparted by vanes 24 of swirl generator insert 22. This can be expressed by the formula $$\text{Swirl Factor} = \frac{rR}{D2Q}$$

Combustion burner 10, as described, can use excess air that will lower flame temperature to help reduce the thermal NOx produced. With the right configuration of the combustion tube, the exhaust stream speed can be increased to 150 ft/sec and would be expected to have a temperature of at least 1800 F. The instrumentation and program would be able to hold a proper fuel/air ratio when barometric changes occur. This burner and support equipment, once programmed for the altitude (site location), may only require tuning when appliance is moved to new location.

Advantages

The design of the B1 burner was designed to be a low NOx, high turn down rate, low cost and high heat transfer swirl burner. Combined with instrumentation to control fuel/air ratio, this burner can produce 100% combustion with no CO present in the exhaust stream with an O2 content from 1% to 6%.

This design is very flexible and maintains 100% combustion efficiency even on turn down. It can burn sub Stoichiometric, or with extra O2 in exhaust stream. No change is required to the burner hardware to combust Syn Gas, Field Gas, Natural Gas or Propane. The combustion at programmed fuel/air ratios is very stable and reliable. The exhaust stream speed can be increased to be project specific. This burner can operate with air pressure of 100 PSI or several inch WC depending on bore size and BTU requirements.

The distribution of the gas thru several jets that are imbedded in the bore wall was designed for maximum even distribution with the swirling air mass being pushed to the bore wall by the circular flow. For simplicity and low cost, the swirl generator insert was designed to cause a swirl motion to the combustion air with minimal pressure loss thru the device. The properties of the swirl motion can be changed by substituting one swirl generator insert with another swirl generator insert having different properties.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A combustion burner, configurable for tuning to an appliance to form a combined system for adjusting exhaust flow and heat transfer, comprising:

a tubular burner body having a sidewall, an air inlet end, a combustion gases outlet end and a central bore that extends between the air inlet end and the combustion gases outlet end being insertable into the appliance;

a swirl generator insert positioned across the central bore, the swirl generator insert being a convergent nozzle having vanes configured to impart a swirl pattern with minimal pressure loss to an axial flow of forced air passing from the air inlet end through the swirl generator insert, the swirl generator insert being relatively thin such that a diameter of the insert exceeds a length of the insert, and the swirl generator insert being removable and replaceable to change vane properties for tuning the combined system;

an annular fuel gas manifold positioned in the central bore, downstream of the swirl generator insert, the gas manifold having a plurality of gas jets positioned adjacent to the sidewall at spaced intervals 360 degrees around the gas manifold to inject fuel into the swirling axial air flow within the central bore;

a mixing chamber downstream of the gas manifold to mix fuel gas from the gas jets with the forced air exiting the swirl generator insert to create a fuel/air mixture;

an annulus spool positioned within the mixing chamber to constrict the central bore and define a diameter of the mixing chamber through which the swirling fuel/air mixture passes, the annulus spool being removable and interchangeable to further tune the combined system by setting the mixing chamber diameter;

a combustion chamber downstream of the mixing chamber; and an igniter passage extending through the burner body to position an igniter downstream of the mixing chamber to ignite the fuel/air mixture entering the combustion chamber, wherein the combustion burner is configured for adjustments to the swirl generator insert and the annulus spool to set exhaust velocity, and adjust heat transfer rate and residence time, and combustion efficiency in the combined system.

2. The combustion burner of claim 1, wherein the annulus spool is removable and interchangeable to set the diameter of the mixing chamber prior to operation for tuning the combined system.

3. The combustion burner of claim 1, wherein the burner body is comprised of a first portion housing the mixing chamber and a second portion housing the combustion chamber, the first portion having a first flange, the second portion having a second flange, the burner body being assembled by coupling the first flange of the first portion with the second flange of the second portion.

4. The combustion burner of claim 1, wherein the swirl generator insert is removable and interchangeable to change at least one of vane pitch, number of vanes, or surface texture for tuning the combined system.

5. The combustion burner of claim 1, wherein a length of a combustion tube associated with the combustion chamber is dependent on geometry of the appliance to facilitate tuning of the combined system.

6. A method of tuning a combustion burner to an appliance, comprising: providing the combustion burner of claim 1; inserting the combustion gases outlet end of the tubular burner body into the appliance to form a combined system, wherein a length of a combustion tube associated with the combustion chamber is selected based on geometry of the appliance; replacing the swirl generator insert to change vane properties for tuning the combined system; and interchanging the annulus spool to set the mixing chamber diameter, thereby adjusting exhaust velocity, heat transfer rate, residence time, and combustion efficiency in the combined system.

7. The method of claim 6, further comprising adjusting an air/fuel ratio in the combustion burner to operate with different fuels, including diesel or used motor oil, while maintaining efficiency in the combined system.

* * * * *